United States Patent [19]

Takano et al.

[11] 4,094,676

[45] June 13, 1978

[54] NON-SILVER SALT TYPE PHOTOSENSITIVE COMPOSITION

[75] Inventors: Hiroshi Takano, Gotenba; Masatsugu Yoshino, Numazu; Hiroshi Naka, Yokohama; Yoshinobu Ito; Tadao Matsushika, both of Fuji, all of Japan

[73] Assignee: Asahi Kasei Kogyo Kabushiki Kaisha, Osaka, Japan

[21] Appl. No.: 768,507

[22] Filed: Feb. 14, 1977

[30] Foreign Application Priority Data

Feb. 16, 1976 Japan ..... 51-5114938

[51] Int. Cl.[2] ..... G03C 1/52

[52] U.S. Cl. ..... 96/90 R; 96/88

[58] Field of Search ..... 96/90 R, 88

[56] References Cited

U.S. PATENT DOCUMENTS

| | | | |
|---|---|---|---|
| 3,042,516 | 7/1962 | Waiver | 96/90 R |
| 3,164,467 | 1/1965 | Sprague et al. | 96/90 R |
| 3,775,123 | 11/1973 | Takano et al. | 96/90 R |

*Primary Examiner*—Won H. Louie, Jr.

*Attorney, Agent, or Firm*—Burgess, Dinklage & Sprung

[57] ABSTRACT

A novel non-silver salt type photosensitive composition which comprises (A) N,N'-diphenyl-p-phenylenediamine as a color developing agent and tetramethylthiuram disulfide which unexpectedly functions rather as another color developing agent than as a storage stabilizer, (B) an organic halide compound as a photoactivator, (C) a salicylic acid derivative as a storage stabilizer for an unexposed photosensitive material, (D) thiourea which functions rather as an agent capable of functioning as both an anti-foggant at and after image formation and a contrasting agent than as a storage stabilizer, and (E) at least one member selected from the group consisting of (i) 2-methylindole, (ii) 2-mercaptothiazoline and (iii) p-diethylaminobenzaldehyde as a color tone adjusting agent. A photosensitive material or film obtained from the present photosensitive composition has an excellent storage stability in the unexposed state, and can give, only by dry process, a blackish brown image having a high photographic density and a high contrast, with fog occurrence reduced.

7 Claims, 2 Drawing Figures

NON-SILVER SALT TYPE PHOTOSENSITIVE COMPOSITION

Figure 1:
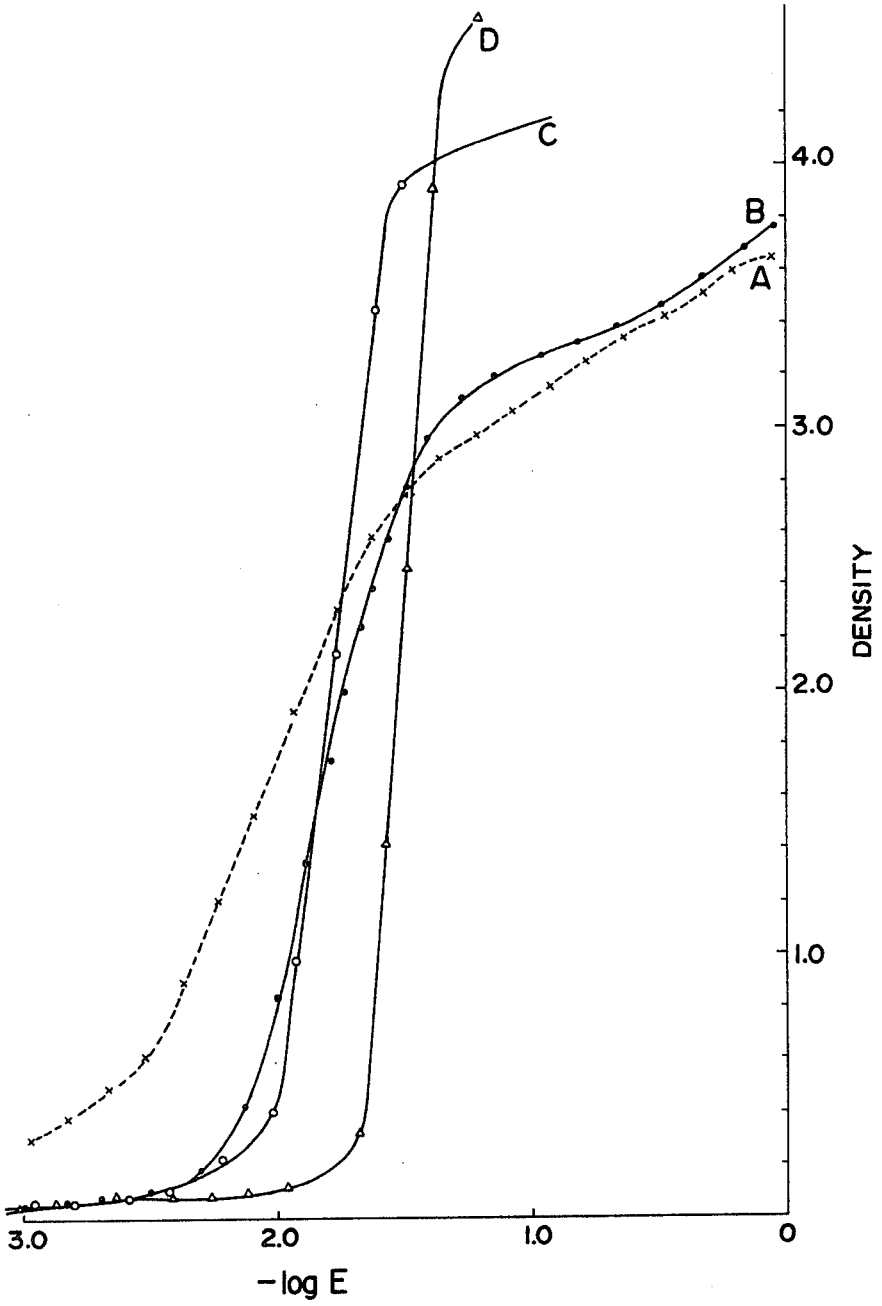

This invention relates to a non-silver salt type photosensitive composition which has excellent photographic characteristics. More particularly, this invention is concerned with a non-silver salt type photosensitive composition which can give a blackish brown image having a high photographic density and a high γ-value, with fog occurrence reduced and has an excellent storage stability for an unexposed photosensitive material. More specifically stated, according to this invention, there is provided a non-silver salt type photosensitive composition capable of forming an image in a short time by dry processes, which comprises (A) a color developing agent comprising N,N'-diphenyl-p-phenylenediamine and tetramethylthiuram disulfide, (B) a photoactivator comprising an organic halide compound, (C) a salicylic acid derivative as a storage stabilizer for an unexposed photosensitive material, (D) thiourea as an agent for preventing of fog occurrence at and after image formation and enhancing the γ-value, and (E) at least one member selected from the group consisting of 2-methylindole, 2-mercaptothiazoline and p-diethylaminobenzaldehyde as an agent for adjusting the color tone and increasing the photographic density and the contrast.

There have already been proposed many non-silver salt type photosensitive compositions in which an arylamine is employed as a color developing agent and an organic halide compound as a photoactivator. On the other hand, U.S. Pat. No. 3,042,516 can be mentioned as an example in which an inorganic or organic sulfur compound is further incorporated in the above-mentioned compositions with the purpose of improving the storage stability. However, since most of these conventional compositions are relatively low with respect to the photographic density of the developed color and the contrast represented by the γ-value, they are unsuitable as a material required to form an image having a high γ-value and a high photographic density, such as a material for a lith-film to be employed in a print developing process.

Conventional so-called silver salt type photosensitive compositions having a silver halide in a photosensitive layer are used to provide a wide variety of photosensitive films having various characteristics ranging from the low γ-value to the high γ-value according to demands. Particularly, a photosensitive film of this type which can form an image having a high photographic density and a high γ-value is widely employed as a lith-film in the field of a print developing. Generally, the lith-film is required not only to form a sharp image having a high photographic density and a high contrast, but also not to bring about fog and discoloration by the secondary light exposure. In order to obtain an image having a high photographic density and a high contrast with the use of a lith-film of the silver salt type, it is required to employ a special developing agent and effect development under special conditions as different from the agent and conditions employed for the ordinary photograph, and further required to pay close attention to the storage and handling of the developing agent with respect to its stability, leading to complicatedness of the developing operations.

The inventors of the present invention have made extensive and intensive investigations with a view to developing an improved photosensitive material which can give an image having a high photographic density, a high contrast and a good storage stability, with fog occurence reduced, while overcoming the above-mentioned defects which are unavoidable in the silver salt type photosensitive compositions. As a result, it has surprisingly been found that when a salicylic acid derivative, thiourea and at least a member selected from the group consisting of 2-methylindole, 2-mercaptothiazoline and p-diethylaminobenzaldehyde are incorporated, in small amounts, into a base matrix comprising N,N'-diphenyl-p-phenylenediamine, which is one of arylamines, and tetramethylthiuram disulfide employed as a color developing agent, and an organic halide compound such as carbon tetrabromide, iodoform or the like as a photoactivator, there is provided a non-silver salt type photosensitive composition which is excellent in the storage stability of the raw photosensitive material and can give an image which is so sharp with respect to the rise of the photographic characteristic curve and so high with respect to the photographic density and the γ-value that the image is extremely clear. It has further been found that the image obtained on a photosensitive material made from said composition is stable, that is, hardly brings about fog and discoloration by the secondary light exposure. In the aforementioned U.S. Pat. No. 3,042,516, it is disclosed that the storage stability is improved by adding a sulfur compound such as tetramethylthiuram disulfide or thiourea to a combination of an arylamine and an organic halide compound. However, it has unexpectedly been found according to the investigation of the present inventors that tetramethylthiuram disulfide forms a coloring matter together with an organic halide compound by light irradiation and therefore acts as a color developing agent. It has further been revealed that addition of thiourea causes the rise of the photographic characteristic curve of the image obtained therefrom to be sharp, and 2-methylindole, 2-mercaptothiazoline or p-diethylaminobenzaldehyde, when further added alone or in mixture thereof, they serve to be as an auxiliary agent for the thiourea and also to increase the density of the developed color. It is noted that the sharp image obtained from the present composition which is so improved with respect to the photographic density and the γ-value by the synergistic effect of the above-mentioned additives hardly brings about fog caused by coloration in the background and hardly undergo discoloration even if it is irradiated with light afterwards, thus enabling the beautiful image to be stably maintained. It is further to be noted that addition of a salicylic acid derivative to this photosensitive composition system improves the storage stability for a raw photosensitive material.

Another advantage of this invention consists in that all treating operations are conducted by dry processes and it is therefore not required to use a large amount of water in the preparation of a photosensitive material and also in the development and fixation as different from the case of the conventional silver salt type photosensitive composition. In treating the silver salt type photosensitive composition, many kinds of inorganic materials are used. Therefore, water is usually used as a solvent for various necessary operations and it is further required to wash out the unreacted materials with a large amount of water in order to accomplish the complete fixation. Further, in order to secure the constant quality of images, the operational conditions of the development and the fixation must be so strictly set that considerable skill is required. By contrast, the non-silver salt type photosensitive composition according to the present invention has a great advantage that the treatment of obtaining an image can be conducted very simply. Illustratively stated, according to the present non-silver type photosensitive composition, there can be obtained a stable beautiful image by subjecting a photosensitive film made from the present composition to direct contact printing-out light exposure to form an image and subsequently heating the film to evaporate the unreacted organic halogen compound therefrom. Accordingly, the non-silver salt type photosensitive composition according to the present invention has not only excellent properties which cannot be realized by the silver salt type photosensitive compositions but also a great advantage that it gives a sharp image having a high photographic density and a high $\gamma$-value which have not been able to be attained by the conventional non-silver salt type photosensitive compositions consisting essentially of an arylamine and an organic halide compound.

Figure 2:
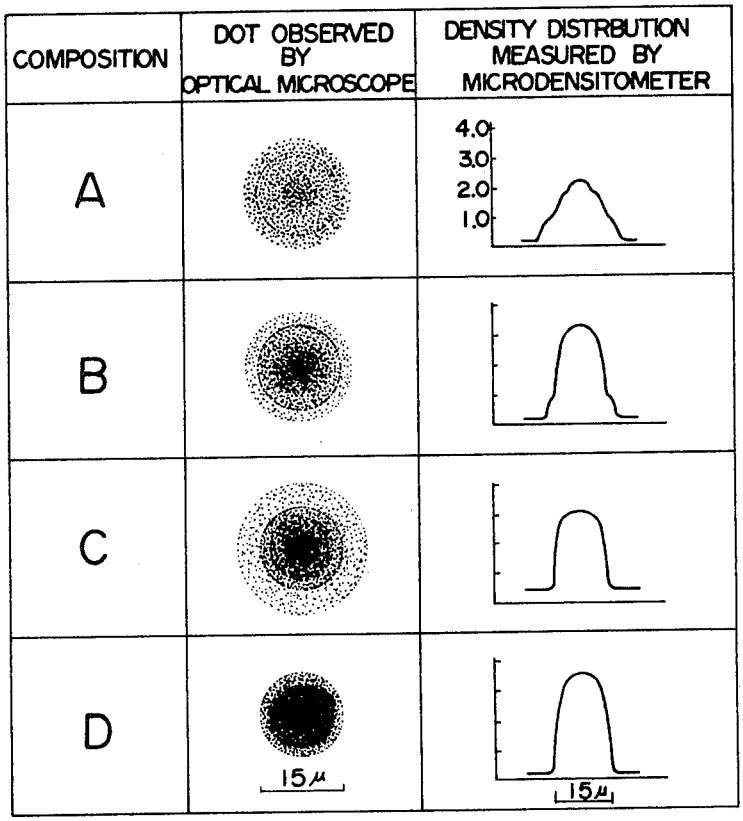

The foregoing and other objects, features and advantages of the present invention will be apparent to those skilled in the art from the following detailed description and appended claims taken in connection with the accompanying drawings in which:

FIG. 1 shows a graph of photographic density against quantity of light exposure of referential photosensitive compositions; and FIG. 2 shows illustrations of optical microscopic observations of the positive dotted images obtained using the compositions in FIG. 1 and density distributions of the dotted images measured by a microdensitometer.

According to the present invention, there is provided a non-silver salt type photosensitive composition which comprises (A) N,N'-diphenyl-p-phenylenediamine and tetramethylthiuram disulfide as a color developing agent, (B) an organic halide compound as a photoactivator liberating therefrom a free radical upon light irradiation, (C) a salicylic acid derivative as a storage stabilizer for an unexposed photosensitive material, (D) thiourea as an agent capable of functioning as both an anti-foggant at and after image formation and a constrasting agent, and (E) at least one member selected from the group consisting of (i) 2-methylindole, (ii) 2-mercaptothiazoline and (iii) p-diethylaminobenzaldehyde as a color tone adjusting agent.

In the non-silver salt type photosensitive composition according to the present invention, a color developing agent comprising in combination N,N'-diphenyl-p-phenylenediamine and tetramethylthiuran disulfide. As a photoactivator, any compound may be employed so far as it is capable of liberating a free radical upon light irradiation. Representative examples of photoactivators include iodoform, carbon tetrabromide, bromoform, pentabromoethane, tribromoacetamide, 2-tribromomethylsulfonyl-6-methoxybenzthiazole, o-nitro-2,2,2-tribromoacetophenone and the like. They may be employed alone or in combination. Of the above-mentioned, iodoform and carbon tetrabromide are especially preferable.

As examples of salicylic acid derivatives as a storage stabilizer for an unexposed raw photosensitive material, there can be mentioned 5,5'-methylenedisalicylic acid, 5-chlorosalicylic acid, 3-phenylsalicylic acid and the like. 5,5'-Methylenedisalicylic acid is especially preferable. They may be employed alone or in combination.

As an anti-foggant and contrasting agent (hereinafter often referred to as "a picture improving agent") thiourea is used.

As a color tone adjusting agent, there can be mentioned 2-methylindole, 2-mercaptothiazoline and p-diethylaminobenzaldehyde. 2-Methylindole is especially preferable. They may be employed alone or in combination.

A sensitizing agent and/or the like may optionally be further added to the above-mentioned main photosensitive composition without causing any trouble. As examples of spectral sensitizing agents there can be mentioned acridine type dyes, cyanine type dyes, merocyanine type dyes, styryl type dyes and the like. As examples of chemical sensitizing agents, there can be mentioned benzaldehyde, ascorbic acid, benzophenone and the like.

A non-silver salt type photosensitive material or film according to the present invention may be easily prepared as follows. The above-mentioned color developing agent, photoactivator, storage stabilizer for the raw photosensitive material, picture improving agent, binder and the like are dissolved or dispersed in a suitable solvent. The resulting solution or dispersion is applied, coatingly or impregnatingly, onto the surface of a support, followed by evaporation of the solvent, to give a desired product. The thickness of the photosensitive composition layer may be 5 to 20 $\mu$, preferably 8 to 12 $\mu$.

Any kind of support may be employed so far as it can support thereon the photosensitive composition in the form of a uniform mixture applied, coatingly or impregnatingly, onto its surface. Examples of supports include various kinds of synthetic resin films such as a polyester film, a polyvinyl acetate film and the like, paper, glass and the like.

Any kind of solvent may be employed in the preparation of the photosensitive material so far as it can dissolve or disperse the color developing agent, the storage stabilizer for the raw photosensitive material, the photoactivator, the binder and the like. Specific examples of solvents include acetone, benzene, carbon disulfide, chloroform, tetrahydrofuran, methyl ethyl ketone and the like. These solvents may be used alone or in mixture.

As examples of binders, there can be mentioned various kinds of synthetic resins such as polyvinyl alcohol, polystyrene, polymethyl methacrylate, polyvinyl chloride, polyvinyl acetate and the like. These resins may be used alone or in mixture.

The range of the amount, in terms of part by weight, of each component to be advantageously used per 100 parts by weight of the binder in the photosensitive composition according to the present invention is shown in Table 1. The ranges of the amount ratios of the color developing agent to the organic halide compound, the storage stabilizer, the picture improving agent and the color tone adjusting agent are also shown in Table 1.

Table 1

| Compnents | Amount, part by weight |
|---|---|
| Solvent | 500 - 2000 |
| Organic halide compound | 50 - 200 |
| Color developing agent | |
| N,N'-Diphenyl-p-phenylenediamine (a) | 5 - 50 |
| Tetramethylthiuram disulfide (b) | 5 - 50 |

Table 1-continued

| Compnents | Amount, part by weight |
|---|---|
| | (a:b = 1:10 - 10:1) |
| Storage stabilizer (Salicylic acid derivative) | 0.1 - 5 |
| Picture improving agent (Thiourea) | 0.1 - 5 |
| Color tone adjusting agent 2-Methylindole 2-Mecraptothiazoline p-Diethylaminobenzaldehyde | 0.5 - 10 |
| Ratio by weight | |
| Color developing agent/Organic halide compound | 1:20 - 2:1, preferably 1:3 - 1:1 |
| Color developing agent/Storage stabilizer | 2:1 - 1,000:1, preferably 5:1 - 20:1 |
| Color developing agent/Picture improving agent | 2:1 - 1,000:1, preferably 5:1 - 20:1 |
| Color developing agent/ Color tone adjusting agent | 1:1 - 200:1, preferably 2:1 - 20:1 |

When the photosensitive material film prepared by the aforementioned procedures is closely contacted with a negative film according to necessity and exposed to light from a light source capable of emitting ultraviolet rays, there can be immediately formed a colored image. For example, the photosensitive material is closely contacted with a dotted silver type negative film and exposed to light to give a sepia positive image having clear outlines of dots. Fixation of the photosensitive material after image formation may be conducted, for example, by heating it with heated air, by passing it through between heated rolls or by irradiating it with far infrared rays. Every method gives a good result.

The following examples illustrate the invention and its great advantage in more detail but are not to be construed as limiting the scope thereof.

REFERENTIAL EXAMPLE 1

1.3 g. of N,N'-diphenyl-p-phenylenediamine, 1.8 g. of tetramethylthiuram disulfide, 3.98 g. of carbon tetrabromide, 7.09 g. of iodoform and 10 g. of polymethyl methacrylate were dissolved in 100 ml. of tetrahydrofuran at room temperature to give a base solution (composition A). Subsequently, compositions B, C and D were prepared by adding a picture improving agent and/or a color tone adjusting agent to 5 ml. of the base solution (composition A) as follows.

Composition B: 4 mg. of thiourea were added to 5 ml. of the composition A.

Composition C: 7 mg. of 2-methylindole and 9 mg. of p-diethylaminobenzaldehyde were added to 5 ml. of the composition A.

Composition D: 4 mg. of thiourea, 7 mg. of 2-methylindole and 9 mg. of p-diethylaminobenzaldehyde were added to 5 ml. of the composition A.

Each of the above-mentioned photosensitive compositions was applied onto a 100 $\mu$-thick polyethylene terephthalate (PET) film at a coating volume of 100 ml. per square meters of the film by a doctor method and dried, under a yellow safelight lamp (manufactured and sold by Toki Denki Kogyo K. K., Japan). Each of the thus-prepared films was closely contacted with a step-tablet (manufactured and sold by Eastman Kodak Co., Ltd., U.S.A.; This was employed in order to control a quantity of light exposure.) and exposed at a distance of 1 m for 3 minutes to light from a 3 KW super-pressure mercury lamp (P-802-1 type; manufactured and sold by Dainippon Screen Seizo K. K., Japan), followed by fixation at 120° C. for 5 minutes using a 1.2 KW heated-air dryer (manufactured and sold by Takabayashi Rika K. K., Japan). Photographic densities of sepia images were examined using an automatic equilibrium densitometer with a blue filter (manufactured and sold by Narumi Shokai K. K., Japan) and there were obtained therefrom photographic characteristic curves with the abscissa representing $-\log E$ in which E is a quantity of light exposure (1x. sec.) and the ordinate representing a photographic density. Herein, the photographic density has no unit. The automatic equilibrium densitometer was manufactured in conformity with Macbeth Transmission Densitometer TD-500 (manufactured and sold by Macbeth Co., U.S.A., as a standard instrument, in accordance with the rules of ASA PH2.19-1959.). The photographic characteristic curves are shown in FIG. 1 in the accompanying drawing. More illustrative photographic characteristics of the compositions are shown in the following Table 2, in which $D_{10s.}$ represents a photographic density of color developed by exposing each photosensitive film for 10 seconds to light from 3 KW super-pressure mercury lamp, $D_{min.}$ represents a photographic density of the unexposed area of each photosensitive film and the $\gamma$-value is one obtained from each photographic characteristic curve in FIG. 1. It is apparent from Table 2 that the composition D is excellent as compared to the compositions A, B and C.

Table 2

| Composition | $D_{10s.}$ | $D_{min.}$ | $\gamma$-value |
|---|---|---|---|
| A | 2.95 | 0.12 | 2.3 |
| B | 3.15 | 0.05 | 3.2 |
| C | 4.06 | 0.05 | 8.0 |
| D | 4.53 | 0.05 | 17.4 |

REFERENTIAL EXAMPLE 2

A photosensitive material produced from each of the compositions A, B, C and D prepared in Referential Example 1 was closely vacuum-contacted with a silver salt type film having a negative dotted image thereon and exposed at a distance of 1m for 15 seconds to light from the 3 KW super-pressure mercury lamp, following by fixation at 120° C. for 5 minutes using the heated-air dryer. Each of the obtained sepia positive dotted images was observed (×400) by an optical microscope BHC (trade name of an optical microscope manufactured and sold by Olympus Kogaku Kogyo K. K., Japan), and is shown in FIG. 2. As is apparent from FIG. 2, the image on the photosensitive material produced from the composition A had dots having a lower photographic density of the developed color as compared with the others and having a milky ring around the dots. The image on the photosensitive material produced from the composition B had dots still having a thinner milky ring around them. The image on the photosensitive material produced from the composition C had sharp dots but the base film itself was slightly discolored. On the contrary, it was confirmed that the image on the photosensitive material produced from the composition D had dots having the highest photographic density of the developed color and having no ring around the dots so that it was very sharp. These dotted images were further examined using "Sakura microdensitometer PDM-5" (trade name of a microdensitometer manufactured and sold by Konishiroku Shashin Kogyo K.K., Japan). The results are shown in the graphs in FIG. 2, wherein the ordinate represents the photographic density and the abscissa represents the distance from the center of the dot. The illustrations of the optical microscopic observations are also shown in FIG. 2. Both lines ⊢⊣ at the bottom of FIG. 2 show the enlarged scale meaning a real length of 15 μ.

REFERENTIAL EXAMPLE 3

For examining a image stability, compositions E and F were prepared by adding a additive or additives to 5 ml. of the composition A prepared in Referential Example 1 as follows.

Composition E: 15 mg. of 2-mercaptothiazoline were added to 5 ml. of the composition A.

Composition F: 4 mg. of thiourea and 15 mg. of 2-mercaptothiazoline were added to 5 ml. of the composition A.

Photosensitive liquids respectively containing the aforementioned compositions A, B, C and D, and the above-mentioned compositions E and F were each applied onto a 100 μ-thick PET film in a thickness of 10 μ in a dry state under the yellow safelight lamp to give a photosensitive material. Subsequently, each photosensitive material was closely contacted with the steptablet and exposed at a distance of 1m for 3 minutes to light from the 3 KW super-pressure mercury lamp, immediately followed by fixation at 120° C for 5 minutes using the heated-air dryer. The photographic density of the color developed on the unexposed area ($D_{min.}$) of the photosensitive material was examined using the automatic equilibrium densitometer with the blue filter. Each photosensitive material was then exposed at a distance of 5 cm for 15 hours to light from five 15 W black lamps (manufactured and sold by Tokyo Shibaura Denki K.K., Japan) capable of emitting strong ultraviolet rays to conduct an accelerated test of the image stability. The photographic density of the color developed on the photosensitive material after exposure to light from the black lamps was examined in the same manner as described above. The results are shown in Table 3.

Table 3

| Composition | Photographic density of developed color ($D_{min.}$) Before secondary light exposure | After secondary light exposure |
|---|---|---|
| A | 0.12 | 0.22 |
| B | 0.05 | 0.23 |
| C | 0.07 | 0.41 |
| D | 0.05 | 0.14 |
| E | 0.06 | 0.29 |
| F | 0.06 | 0.13 |

It is recognized from the results with respect to the compositions D and F shown above that thiourea had a stabilizing activity for the image in the present composition system.

EXAMPLE 1

For examining the effect of a storage stabilizer for an unexposed photosensitive material, 30 mg. of 5,5'-methylenedisalicylic acid were added as a storage stabilizer to 5 ml. of the composition D prepared in Referential Example 1 to form a composition G.

Photosensitive liquids respectively containing the compositions D and G were each applied onto a 100 μ-thick PET film and dried in the same manner as described in Referential Example 1 to obtain a photosensitive material.

The raw photosensitive materials produced from the compositions D and G were stored at 45° C for varied periods up to 7 days. The changes with the lapse of time were examined with respect to photographic density as follows. Each photosensitive material was examined with respect to photographic density of the color caused by fogging ($D_{min.}$) at each of the beginning and the end of the storing period. Each photosensitive material was also examined with respect to photographic density of the color developed by exposure at a distance of 1 m for 10 seconds to light from the 3 KW super-pressure mercury lamp and then heat-fixed at 120° C for 5 minutes ($D_{10s.}$) at each of the beginning and the end of the storing period. The storage stability was calculated using the following equation:

$$\text{Storage stability (\%)} = \frac{(D_{10s.} - D_{min.}) \text{ at the end of each storing period}}{(D_{10s.} - D_{min.}) \text{ at the beginning}} \times 100$$

These results are shown in Table 4.

The γ-value of the photosensitive material produced from the composition G was almost the same value, γ-value = 17.0, as that of the photosensitive material produced from the composition D.

Table 4

| Composition | Storing period | 0 | 1 day | 5 days | 7 days |
|---|---|---|---|---|---|
| D (Blank) | $D_{10s.}$ / $D_{min.}$ | 4.53 / 0.05 | 4.13 / 0.06 | 3.80 / 0.86 | 3.55 / 1.61 |
| | Storage stability (%) | 100 | 91 | 66 | 43 |
| G | $D_{10s.}$ / $D_{min.}$ | 4.10 / 0.05 | 3.90 / 0.05 | 3.55 / 0.07 | 3.43 / 0.08 |
| | Storage stability (%) | 100 | 95 | 86 | 83 |

It is apparent from Table 4 that 5,5'-methylenedisalicylic acid has an excellent storage-stabilizing activity.

EXAMPLE 2

| | |
|---|---|
| N,N'-Diphenyl-p-phenylenediamine | 0.05 mole/liter |
| Tetramethylthiuram disulfide | 0.08 mole/liter |
| Carbon tetrabromide | 0.12 mole/liter |
| Iodoform | 0.18 mole/liter |
| 5,5'-Methylenedisalicylic acid | 0.02 mole/liter |
| Thiourea | 0.01 mole/liter |
| 2-Methylindole | 0.02 mole/liter |
| Polymethyl methacrylate | 10% by weight |
| Solvent: Tetrahydrofuran | |

A photosensitive liquid containing the above-mentioned components was applied onto a 100 μ-thick PET film to give a thickness of 10 μ in the dry state and dried, under the yellow safelight lamp, to obtain a photosensitive material. Subsequently, the photosensitive material was closely contacted with the steptablet and exposed at a distance of 1 m for 3 minutes to light from the 3 KW super-pressure mercury lamp, followed by heat-fixation at 120° C for 5 minutes. An image obtained immediately after printing-out has a γ-value of 17.5, a $D_{max.}$ (maximum photographic density attainable) of 4.8, a $D_{min.}$ of 0.05 and a color tone of sepia. Besides, the thus formed image was so stable that the occurrence of fog was hardly observed even after it was stored at room temperature for 6 months. Storage stability of the unexposed raw photosensitive material was also examined in the same manner as described in Example 1. The storage stability at 45° C for 7 days was 85%.

EXAMPLE 3

There was prepared photosensitive liquids containing substantially the same components as described in Example 2 except that an equimolar amount, to that of 2-methylindole, of 2-mercaptothiazoline and that of p-diethylaminobenzaldehyde were respectively used in place of 2-methylindole. Two kinds of photosensitive materials were each then produced in the same manner as described in Example 2. An image was thereafter formed on each of said photosensitive materials in the same manner as described in Example 2. As a result of the same examinations as described in Referential Example 1, the following values with respect to photographic properties were obtained.

In case 2-mercaptothiazoline was added: $\gamma$-value = 16.0, $D_{max.}$ = 3.9, $D_{min.}$ = 0.05

In case p-diethylaminobenzaldehyde was added: $\gamma$-value = 16.5, $D_{max.}$ = 4.2, $D_{min.}$ = 0.06

EXAMPLE 4

There was prepared photosensitive liquids containing substantially the same components as described in Example 2 except that an equimolar amount, to that of 5,5'-methylenedisalicylic acid, of 5-chlorosalicylic acid and that of 3-phenylsalicylic acid were respectively used in place of 5,5'-methylenedisalicylic acid. Two kinds of photosensitive materials were each then produced in the same manner as described in Example 2. Storage stability of each of the photosensitive materials was examined in the same manner as described in Example 1 to give the following result. The values shown below represent storage stabilities at 45° C for 7 days.

In case 5-chlorosalicylic acid was added: Storage stability = 79%

In case 3-phenylsalicylic acid was added: Storage stability = 74%

EXAMPLE 5

The photosensitive material produced from the composition G in Example 1 was closely contacted with a silver salt type film having a positive dotted image thereon, and subjected to light exposure and fixation in the same manner as described in Referential Example 2 to give a clear sepia negative dotted image. A PS plate GAN type 392 (trade name of a printing plate manufactured and sold by Fuji Film Shashin Kogyo K.K., Japan) was closely contacted with the above-mentioned negative image, exposed for 2 minutes to light from the 3 KW super-pressure mercury lamp, immediately subjected to developing treatment using a developing solution DN-2 #510 (trade name of a developing solution manufactured and sold by Fuji Film Shashin Kogyo K.K., Japan), further subjected to washing, surface affinitizing treatment and application of a developing ink PI #801 (trade name of a developing ink manufactured and sold by Fuji Film Shashin Kogyo K.K., Japan), and lastly gummed up with a gum solution GN #62 (trade name of a gum solution manufactured and sold by Fuji Film Shashin Kogyo K.K., Japan), to give a printing plate having a printing image thereon. The developing ink was used in order to protect the oil sensitiveness of the printing image portion.

Printing was conducted using this printing plate. It was confirmed that the obtained print had a clear image on the white ground. The thus obtained print was compared with the print obtained when a silver salt type lith-film is employed as a negative film. As a result, it was also confirmed that both prints has no difference.

[Printing Conditions]

1. Printing machine: Original Heidelberg Offset Kord (trade name of a printing machine manufactured and sold by Heidelberger Druckmaschinen A.G., West Germany)
2. Printing ink: Diatone G S L Black G (trade name of a printing ink manufactured and sold by Sakata Shokai K.K., Japan)
3. Printing paper: Fine quality paper, Toko, Longitudinal direction, 40 Kg/ream (trade name of a printing paper manufactured and sold by Jujo Seishi K.K., Japan)

EXAMPLE 6

| | |
|---|---|
| N,N'-Diphenyl-p-phenylenediamine | 0.05 mole/liter |
| Tetramethylthiuram disulfide | 0.08 mole/liter |
| Carbon tetrabromide | 0.08 mole/liter |
| Iodoform | 0.12 mole/liter |
| 5,5'-Methylenedisalicylic acid | 0.03 mole/liter |
| Thiourea | 0.02 mole/liter |
| 2-Methylindole | 0.03 mole/liter |
| Polymethyl methacrylate | 10 % by weight |
| Solvent: Tetrahydrofuran | |

A photosensitive liquid containing the above-mentioned components was applied onto a 100 $\mu$-thick PET film to give a thickness of 10 $\mu$ in the dry state and dried, under the yellow safelight lamp, to obtain a photosensitive material. Subsequently, the photosensitive material was closely contacted with the steptablet and exposed at a distance of 1 m for 3 minutes to light from the 3 KW super-pressure mercury lamp, followed by heat-fixation at 120° C for 5 minutes. An image obtained immediately after printing-out has a $\gamma$-value of 8.1, a $D_{max.}$ of 3.5, a $D_{min.}$ of 0.05 and a color tone of sepia. Besides, the thus formed image was so stable that the occurrence of fog was hardly observed even after it was stored at room temperature for 6 months. Storage stability of the unexposed raw photosensitive material was also examined in the same manner as described in Example 1. The storage stability at 45° C for 7 days was 90%.

EXAMPLE 7

| | |
|---|---|
| N,N'-Diphenyl-p-phenylenediamine | 0.05 mole/liter |
| Tetramethylthiuram disulfide | 0.05 mole/liter |
| Carbon tetrabromide | 0.10 mole/liter |
| Iodoform | 0.10 mole/liter |
| 5,5'-Methylenedisalicylic acid | 0.02 mole/liter |
| Thiourea | 0.01 mole/liter |
| 2-Methylindole | 0.02 mole/liter |
| Polymethyl methacrylate | 10 % by weight |
| Solvent: Tetrahydrofuran | |

A photosensitive liquid containing the above-mentioned components was applied onto a 100 $\mu$-thick PET film to give a thickness of 10 $\mu$ in the dry state and dried, under the yellow safelight lamp, to obtain a photosensitive material. Subsequently, the photosensitive material was closely contacted with the steptablet and exposed at a distance of 1 m for 3 minutes to light from the 3 KW super-pressure mercury lamp, followed by heat-fixation at 120° C for 5 minutes. An image obtained immediately after printing-out has a γ-value of 7.5, a $D_{max.}$ of 3.3, a $D_{min.}$ of 0.05 and a color tone of sepia. Besides, the thus formed image was so stable that the occurrence of fog was hardly observed even after it was stored at room temperature for 6 months. Storage stability of the unexposed raw photosensitive material was also examined in the same manner as described in Example 1. The storage stability at 45° C for 7 days was 90%.

Characteristic features of the non-silver salt type photosensitive composition according to the present invention can be summarized as follows.

(1) The composition contains both thiourea as a contrasting agent and at least one member selected from the group consisting of 2-methylindole, 2-mercaptothiazoline and p-diethylaminobenzaldehyde as a color tone adjusting agent, so that there is obtained a sharp image having a high photographic density and a high contrast.

(2) A sharp image having a high photographic density and a high contrast is obtained, so that the composition can advantageously be employed as a composition suitable for making a lith-film widely utilized in the field of print developing.

(3) In the composition system according to the present invention, tetramethylthiuram disulfide functions not only as a color developing agent but also as a image stabilizer similarly to thiourea so that the obtained image is stable with fog occurrence reduced.

What is claimed is:

1. A non-silver salt type photosensitive composition which comprises (A) N,N'-diphenyl-p-phenylenediamine and tetramethylthiuram disulfide as a color developing agent, (B) an organic halide compound as a photoactivator liberating therefrom a free radical upon light irradiation, (C) as a storage stabilizer for an unexposed photosensitive material a salicylic acid selected from the group consisting of 5,5'-methylenedisalicylic acid, 5-chlorosalicylic acid and 3-phenylsalicylic acid, (D) thiourea as an agent capable of functioning as both an anti-foggant at and after image formation and a contrasting agent, and (E) at least one member selected from the group consisting of (i) 2-methylindole, (ii) 2-mercaptothiazoline and (iii) p-diethylaminobenzaldehyde as a color tone adjusting agent, the weight amount ratio of the N,N'-diphenyl-p-phenylenediamine to the tetramethylthiuram disulfide ranging from 1:10 to 10:1, the weight amount ratio of said color developing agent to said organic halide compound being 1:20 – 2:1, the weight amount ratio of said color developing agent to said salicylic acid being 2:1 to 1000:1, the weight amount ratio of said color developing agent to the thiourea being 2:1 to 1000:1 and the weight amount ratio of said color developing agent to said color tone adjusting agent being 1:1 to 200:1.

2. A non-silver salt type photosensitive composition as claimed in claim 1 wherein said salicylic acid derivative is 5,5'-methylenedisalicylic acid.

3. A non-silver salt type photosensitive composition as claimed in claim 1 wherein said color tone adjusting agent is 2-methylindole.

4. A non-silver salt type photosensitive composition as claimed in claim 1 wherein said salicylic acid derivative is 5,5'-methylenedisalicylic acid and said color tone adjusting agent is 2-methylindole.

5. A non-silver salt type photosensitive composition as claimed in claim 1 wherein said organic halide compound is at least one member selected from the group consisting of iodoform, carbon tetrabromide, bromoform, pentabromoethane, tribromoacetamide, 2-tribromomethylsulfonyl-6-methoxybenzthiazole and o-nitro-2,2,2-tribromoacetophenone.

6. A non-silver salt type photosensitive composition as claimed in claim 1 wherein said salicylic acid derivative is 5,5'-methylenedisalicylic acid, said color tone adjusting agent is 2-methylindole and said organic halide compound is at least one member selected from the group consisting of iodoform and carbon tetrabromide.

7. A non-silver salt type photosensitive composition as claimed in claim 1 wherein the weight amount ratio of said color developing agent to said organic halide compound is 1:3 to 1:1, the weight amount ratio of said color developing agent to said salicylic acid derivative is 5:1 to 20:1, the weight amount ratio of said color developing agent to the thiourea is 5:1 to 20:1 and the weight amount ratio of said color developing agent to said color tone adjusting agent is 2:1 to 20:1.

* * * * *